US007048510B2

(12) United States Patent
Hedlund

(10) Patent No.: US 7,048,510 B2
(45) Date of Patent: May 23, 2006

(54) PROPELLER SPINNER FOR A MARINE PROPELLER

(75) Inventor: Benny Hedlund, Hönö (SE)

(73) Assignee: AB Volvo Penta, Göteborg (SE)

( * ) Notice: Subject to any disclaimer, the term of this patent is extended or adjusted under 35 U.S.C. 154(b) by 0 days.

(21) Appl. No.: 10/905,300

(22) Filed: Dec. 25, 2004

(65) Prior Publication Data

US 2005/0084383 A1 Apr. 21, 2005

Related U.S. Application Data

(63) Continuation of application No. PCT/SE03/00808, filed on May 20, 2003, now abandoned.

(30) Foreign Application Priority Data

Jun. 25, 2002 (SE) ..... 0201963

(51) Int. Cl.
*B63H 1/14* (2006.01)

(52) U.S. Cl. ..... 416/245 A; 416/146 R; 204/196.37; 440/49

(58) Field of Classification Search ..... 416/146 R, 416/244 B, 245 R, 245 A; 440/49; 204/196.37
See application file for complete search history.

(56) References Cited

U.S. PATENT DOCUMENTS 3,703,341 A * 11/1972 Garofalo ..... 416/245 R
4,077,742 A 3/1978 Goodwin
4,486,181 A * 12/1984 Cavil ..... 440/49
4,604,068 A 8/1986 Guinn

* cited by examiner

*Primary Examiner*—Christopher Verdier
(74) *Attorney, Agent, or Firm*—Novak Druce & Quigg LLP

(57) ABSTRACT

A propeller spinner (5) for a marine propeller (1) having multiple propeller blades (2) attached to a propeller hub (3) that is adapted for attachment to a propeller shaft (4) and includes a sacrificial anodic material for protecting the propeller shaft (4) and/or propeller hub (3) from corrosion. There is included a hollow spinner cone (6) made of a non-anodic material and the spinner cone (6) has at least one perforation in its outer peripheral surface. An anodic insert body (9) that is made of the sacrificial anodic material constitutes an insert body (9) that is substantially contained within the hollow spinner cone (6). The insert body (9) has at least one radical protrusion (10) extending at least partially through said perforation (7) in the spinner cone (6).

12 Claims, 4 Drawing Sheets

PROPELLER SPINNER FOR A MARINE PROPELLER

CROSS-REFERENCE TO RELATED APPLICATION

The present application is a continuation patent application of International Application No. PCT/SE03/00808 filed 20 May 2003 which was published in English pursuant to Article 21(2) of the Patent Cooperation Treaty, and which claims priority to Swedish Application No. 0201963-6 filed 25 Jun. 2002. Said applications are expressly incorporated herein by reference in their entireties.

TECHNICAL FIELD

The present invention relates to a propeller spinner for a marine propeller in which multiple propeller blades are attached to a propeller hub that is adapted for attachment to a propeller shaft. The propeller spinner is adapted for attachment to the propeller shaft and includes a sacrificial anodic material for protecting the propeller shaft and/or propeller hub from corrosion.

BACKGROUND OF THE INVENTION

The use of sacrificial anodes for protecting steel, brass, bronze or aluminum parts from corrosion in sea water is well established in marine engineering. It is thus well known that, for example, steel propeller shafts with bronze bearings are subject to corrosive electrochemical galvanic reaction in sea water that shortens the potential lifetime of the shaft. To protect the shaft from corrosion, a replaceable sacrificial anode is placed near the shaft. The anode is typically made of a metal (most often zinc) that is subject to preferential corrosion relative to the shaft material when the parts are submerged in an electrolyte such as sea water. In such a case, it is desirable to mount the sacrificial anode in a way the permits the anode to be replaced without having to detach the propeller.

A similar propeller design is described in U.S. Pat. No. 4,077,742 in which a nose piece, or so called spinner, apart from its hydrodynamic drag-reducing function, also serves as a sacrificial zinc anode mounted on a reusable brass propeller fastener nut. A problem with this design is, however, that the original outer peripheral contour of the spinner that is shaped for optimum hydrodynamic performance-gradually deteriorates and roughens as corrosion of the anodic material in the spinner proceeds, causing increased drag and loss of propulsion performance.

SUMMARY OF THE INVENTION

The above mentioned problem is alleviated by providing a propeller spinner for a marine propeller having multiple propeller blades attached to a propeller hub adapted for attachment to a propeller shaft. The propeller spinner is adapted for attachment to the propeller shaft and includes a sacrificial anodic material for protecting the propeller shaft and/or propeller hub from corrosion. The invention is especially characterized by the fact that the spinner comprises (includes, but is not necessarily limited to) a hollow spinner cone made of a non-anodic material. The spinner cone has at least one perforation in its outer peripheral surface and an anodic insert body made of sacrificial anodic material. The insert body is substantially contained within the hollow spinner cone and the insert body has at least one radial protrusion extending at least partially through the perforation in the spinner cone.

In an advantageous embodiment of the invention, at least one radial protrusion of the anodic insert body extends fully through a corresponding perforation in the spinner cone in such a way as to form an outer surface which is flush and conforms with the outer peripheral surface of the spinner cone in a non-corroded state of the insert body.

In one embodiment, the hollow spinner cone has multiple perforations in its outer peripheral surface and further has axially extending members located between the perforations so as to form a grid pattern which-upon rotation of the propeller is adapted to generate a hydrodynamic rotational body identical in shape to the original outer peripheral contour of the spinner, in a state where the protrusions of the anodic insert body are at least partially consumed by corrosion.

In one exemplary embodiment, the perforations in the spinner cone and the corresponding radial protrusions of the insert body are longitudinally shaped in the axial direction of the propeller shaft. Further, the perforations in the spinner cone and the corresponding radial protrusions of the insert body may suitably be substantially rectangular.

In one embodiment, the perforations in the spinner cone and the corresponding radial protrusions of the insert body are arranged in multiple axially interspersed rows along the outer peripheral surface of the spinner cone. Preferably, each row includes between six to sixteen perforations and corresponding protrusions.

The anodic insert body may be either removably attached to a reusable spinner cone, or it may alternatively be permanently affixed to the spinner cone, so as to form a single replaceable unit. In the latter case, the spinner cone is preferably substantially made of plastic, and may be molded directly onto the anodic insert body.

Although the anodic insert body may normally be made of zinc, other metals serving as sacrificial anodes may be used alternatively.

The invention further provides a marine propeller comprising multiple propeller blades attached to a propeller hub that is adapted for attachment to a propeller shaft. The propeller is provided with a spinner mounted on the propeller shaft and comprises a sacrificial anodic material for protecting the propeller shaft and/or propeller hub from corrosion. The invention is especially characterized in that the spinner includes a hollow spinner cone made of a non-anodic material, and the spinner cone has at least one perforation in its outer peripheral surface. An anodic insert body made of such sacrificial anodic material is exemplarily substantially contained within the hollow spinner cone and the insert body has at least one radial protrusion extending at least partially through the perforation in the spinner cone.

Other features and advantages of the invention will be described below in the description of suitable embodiments.

BRIEF DESCRIPTION OF THE DRAWINGS

The invention will now be described in greater detail by way of example only and with reference to the attached drawings in which.

DESCRIPTION OF EXEMPLARY EMBODIMENTS OF THE INVENTION

Figure 1:
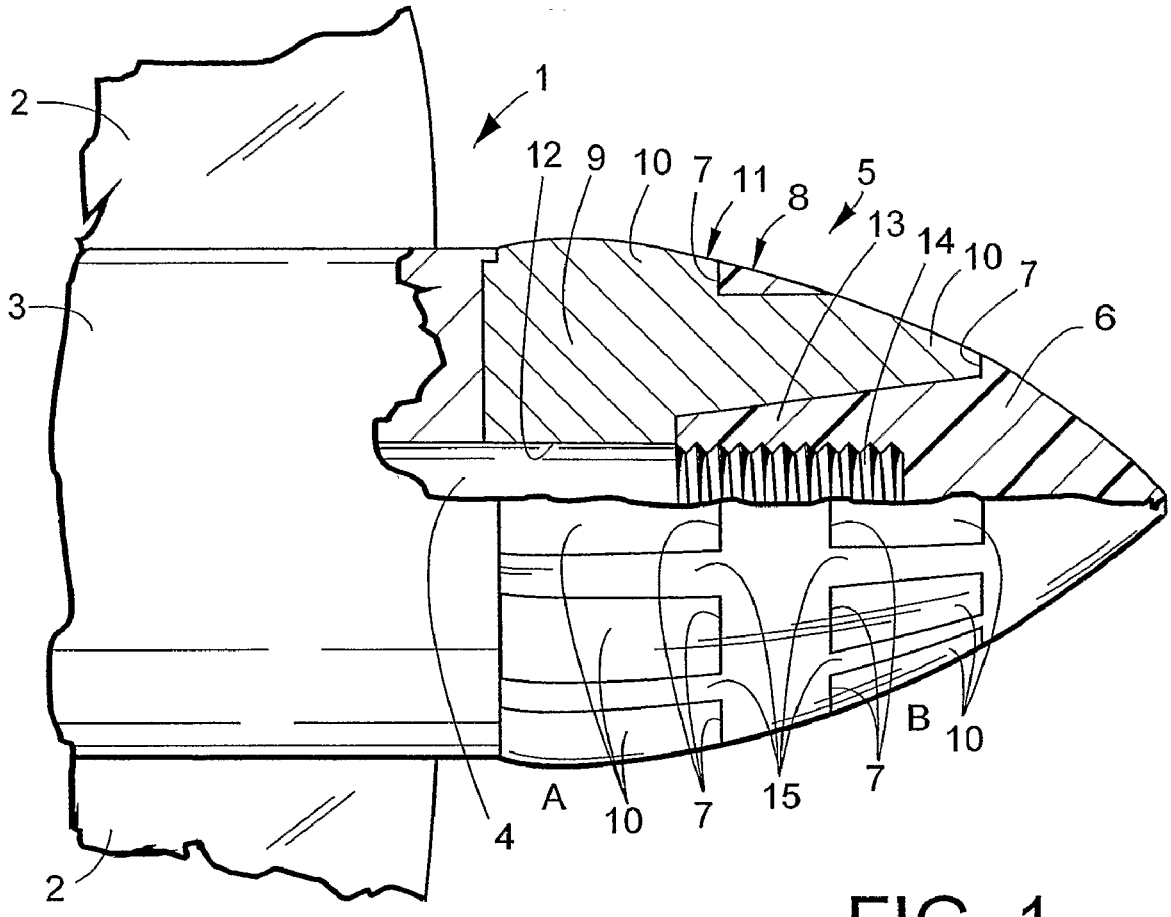
FIG. 1 shows a broken, partial cross-sectional side view of a propeller configured according to the teaching of the present invention, and more particularly, through an exemplary embodiment(s) of the invention. In that Fig., the anodic insert body is new and non-corroded and thus flush with the outer peripheral surface of the hollow spinner cone.

In FIG. 1, reference numeral 1 generally denotes a schematically illustrated marine propeller according to an exemplary embodiment of the invention.

The propeller 1 comprises multiple propeller blades 2 attached to a propeller hub 3, which in turn are each adapted for attachment to a propeller shaft 4.

The propeller 1 is further provided with a generally conical propeller spinner 5 mounted on the end of the propeller shaft 5. The propeller spinner 5 comprises a hollow spinner cone 6 made of a non-anodic material, such as plastic. In the present context, the term non-anodic means that the material of the spinner cone 6 does not act as an anodic material in an electrochemical, galvanic reaction when submerged in sea water.

The hollow spinner cone 6 has multiple perforations 7 in its outer peripheral surface 8. The shape and number of these perforations 7 will be described in closer detail below.

In order to protect the propeller shaft 4 and/or the propeller hub 3 from corrosion, the propeller spinner 5 further comprises an anodic insert body 9 made of a sacrificial anodic material such as zinc. The anodic insert body 9 is substantially contained within the hollow spinner cone 6 and is provided with one radial protrusion 10 extending through each of the perforations 7 in the hollow spinner cone 6. As seen in FIG. 1, the anodic insert body 9 is provided with a centrally extending through hole 12 which is directly abutting the propeller shaft 4 in order to galvanically protect the propeller shaft 4 from corrosion.

Each radial protrusion 10 of the anodic insert body 9 extends fully through the corresponding perforation 7 in the spinner cone 6 in such a way as to form an outer surface 11 which is flush and conforms with the outer peripheral surface 8 of the spinner cone 6, in a non-corroded state of the insert body 9, as seen in FIG. 1.

As is apparent from FIG. 1, the spinner 5 serves as a fastening nut for the propeller 1 in the illustrative, and exemplary embodiment. To this end, the hollow spinner cone 6 is provided with a central, internally located and axially extending threaded sleeve portion 13 adapted for engagement with a corresponding threaded end section 14 of the propeller shaft 4. The sleeve portion 13 is generally conically shaped, and the anodic insert body 9 conforms substantially fully to its shape in this embodiment.

Figure 2:
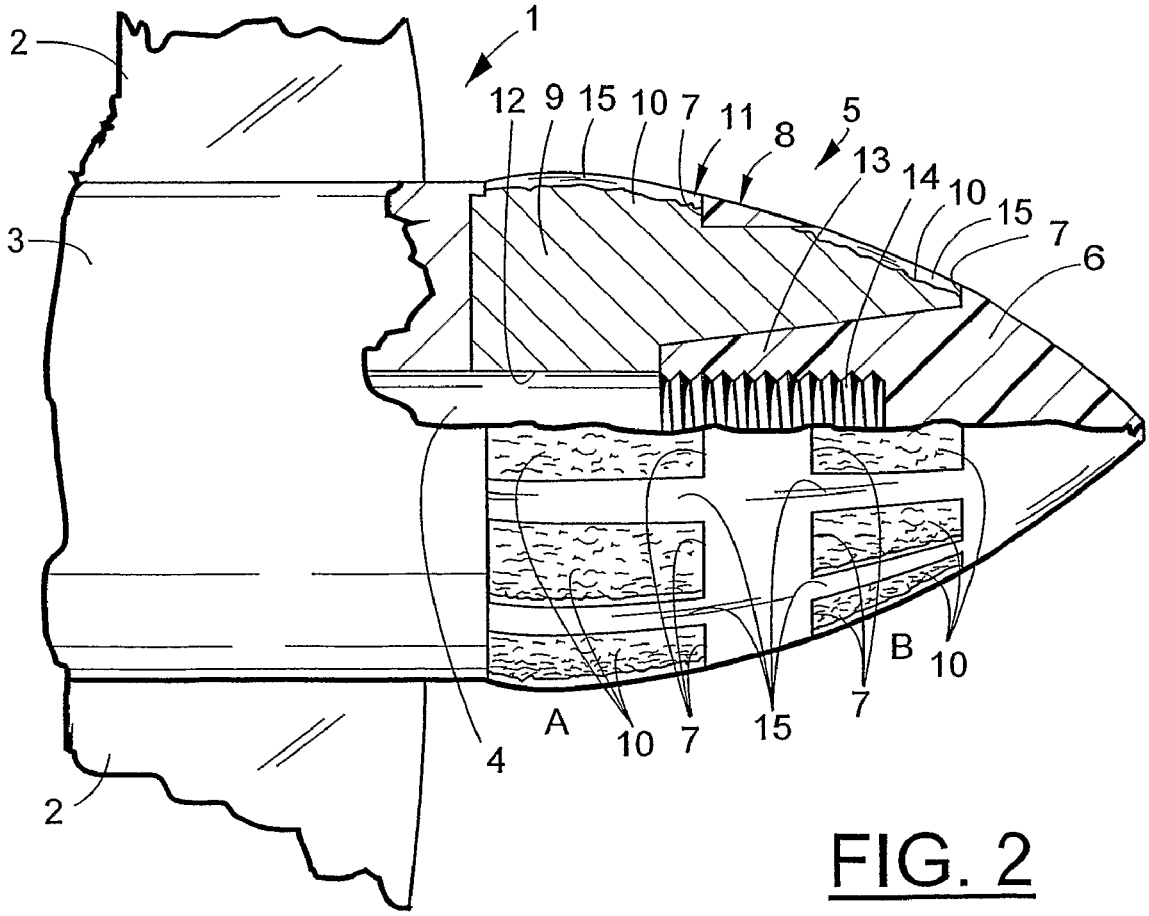
FIG. 2 shows a broken, partial cross-sectional side view of a propeller corresponding to the embodiment shown in FIG. 1. In this Fig., however, the anodic insert body is corroded and thus no longer flush with the outer peripheral surface of the hollow spinner cone.

In FIG. 2, the anodic insert body 9 is shown in a corroded state, and thus the radial protrusions 10 are no longer flush with the outer peripheral surface 8 of the spinner cone 6. In this situation, the original outer peripheral contour of the spinner 5, which is shaped for optimum hydrodynamic performance, is nevertheless maintained during continued rotation of the propeller 1. This is achieved according to the invention, in that the hollow spinner cone 6 has axially extending members 15 located between the perforations 7 so as to form a grid pattern which, upon rotation of the propeller 1, is adapted to generate a hydrodynamic rotational body identical in shape to the original outer peripheral contour of the spinner 5 in a state where the protrusions 10 of the anodic insert body 9 are at least partially consumed by corrosion. This feature of the invention serves to maintain the operational performance of the propeller 1 regardless of the corrosion state of the anodic insert body 9. The feature also provides an indication of when the anodic insert body 9 should be replaced, the corroded surface of the anodic material being clearly visible and tangible within the perforations 7 of the spinner cone 6.

In the illustrated embodiment, the axially extending members 15 are arranged substantially in parallel with the propeller shaft 4. Alternatively, but however, not shown in the illustrations, these members 15 may be arranged obliquely to the extension of the propeller shaft 4, but still in the general axial direction of the propeller shaft 4.

Figure 3:
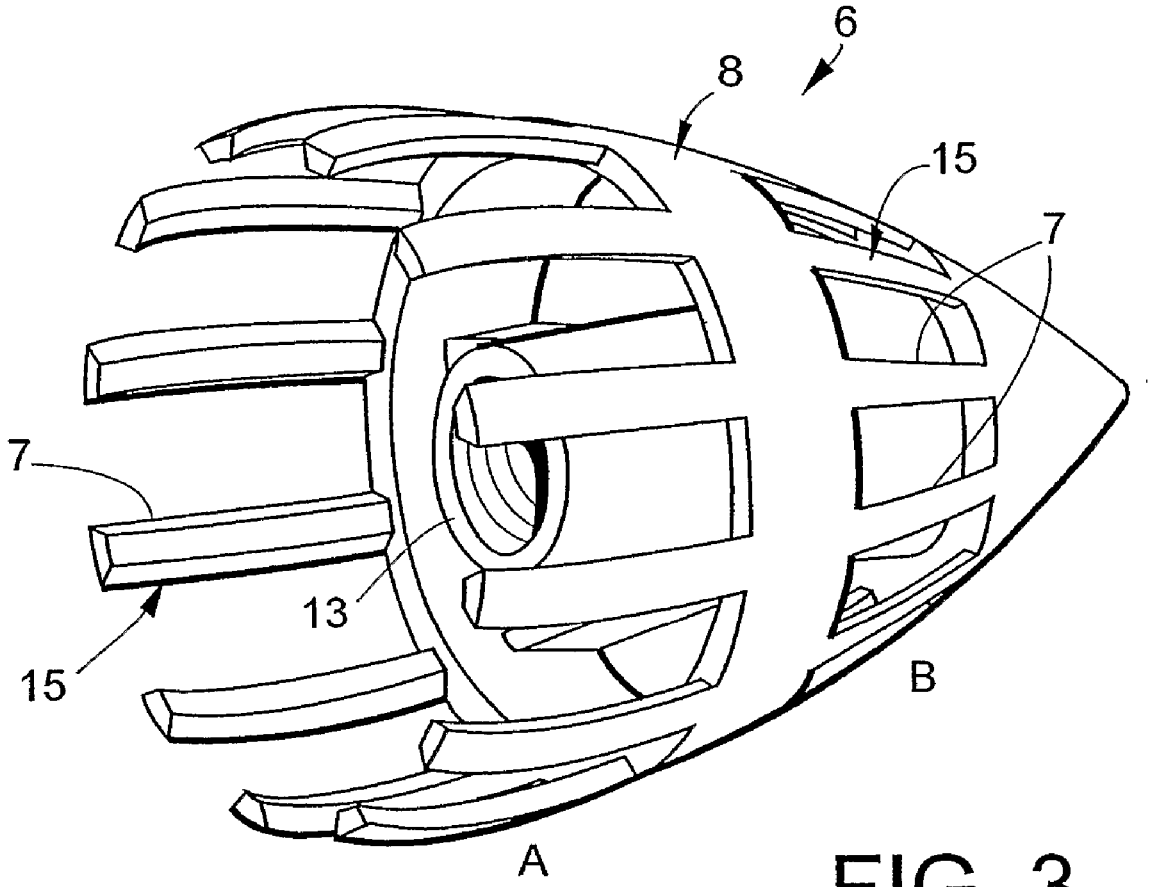
FIG. 3 shows a perspective view of the hollow spinner cone illustrating the grid pattern of perforations in the outer peripheral surface of the spinner cone.

In FIG. 3, the hollow spinner cone 6 is shown separately, and in perspective. The above mentioned grid pattern formed by the perforations 7, and the axially extending members 15, can be clearly observed in this Fig. In the illustrated embodiment(s), the perforations 7 are longitudinally shaped, substantially rectangularly in the axial direction of the propeller shaft 4.

Furthermore, the perforations 7 in the spinner cone 6 are arranged in two axially interspersed rows denoted by "A" and "B," respectively, along the outer peripheral surface 8 of the spinner cone 6. In the illustrated embodiment, each row A and B includes twelve perforations 7, adding up to twenty four perforations in total. In the alternative, the number of perforations may suitably range from six to sixteen perforations 7 in each row A, B (but which is not shown). However, the number of perforations 7 in each rows A and B may not necessarily coincide, and the number of rows may also exceed two.

Figure 4:
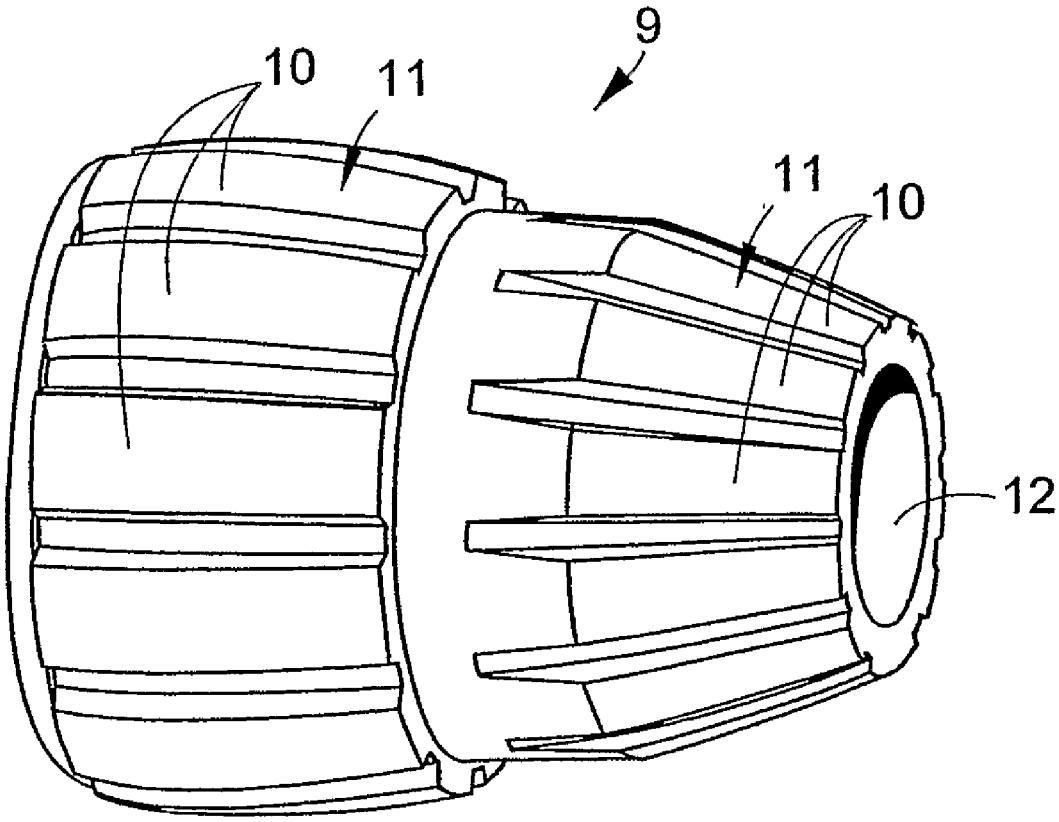
FIG. 4 shows a perspective view of the anodic insert body in a non-corroded state.

FIG. 4 shows a perspective view of the separate anodic insert body 9 that is in a non-corroded state. The number, shape and arrangement of radial protrusions 10 fully corresponds to the perforations 7 in the spinner cone 6.

In one embodiment of the invention, the anodic insert body 9 is removably attached to a reusable spinner cone 6, and thus both the hollow spinner cone 6 and the anodic insert body 9 are shaped in such a way as to permit the insert body 9 to be axially inserted into-and removed from the spinner cone 6. In this case, the reusable spinner cone may advantageously be made of a durable and substantially non-corrosive metal, such as stainless steel.

In an alternative embodiment, the anodic insert body 9 is instead permanently affixed to the spinner cone 6, so as to form a single replaceable unit. In this case, the spinner cone 6 is preferably substantially made of plastic, and may be molded directly onto the anodic insert body 9.

It is to be understood that the invention is by no means limited to the embodiments described above, and may be varied freely within the scope of the patented claims. For example, the hollow spinner cone 6 and the anodic insert body 9 may be provided with only one perforation 7 and one radial protrusion 10 respectively. Furthermore, the radial protrusions 10 may extend only partially through the perforations 7 in the spinner cone 6. Although the anodic insert body may normally be made of zinc, other metals serving as sacrificial anodes may be alternatively used.

What is claimed is:

1. A propeller spinner (5) for a marine propeller (1) having multiple propeller blades (2) attached to a propeller hub (3) that is adapted for attachment to a propeller shaft (4) and the propeller spinner (5) being adapted for attachment to the propeller shaft (4) and comprising a sacrificial anodic material for protecting at least one of the propeller shaft (4) and the propeller hub (3) from corrosion, the propeller spinner (5) comprising:

a hollow spinner cone (6) made of a non-anodic material, said spinner cone (6) having at least one perforation (7) in an outer peripheral surface thereof, and an anodic insert body (9) made of said sacrificial anodic material, said insert body (9) being substantially contained within the hollow spinner cone (6), the insert body (9) having at least one radial protrusion (10) extending at least partially through said perforation (7) in the spinner cone (6).

2. The propeller spinner (5) as recited in claim 1, wherein said radial protrusion (10) of the anodic insert body (9) extends fully through the perforation (7) in the spinner cone (6) in such a way as to form an outer surface (11) that is flush and conforms with the outer peripheral surface (8) of the spinner cone (6), in a non-corroded state of the insert body (9).

3. The propeller spinner (5) as recited in claim 2, wherein said hollow spinner cone (6) has multiple perforations (7) in the outer peripheral surface (8) and axially extending members (15) located between the perforations (7) so as to form a grid pattern which, upon rotation of the propeller (1), is adapted to generate a hydrodynamic rotational body identical in shape to the original outer peripheral contour of the spinner (5) in a state where the protrusions (10) of the anodic insert body (9) are at least partially consumed by corrosion.

4. The propeller spinner (5) as recited in claim 3, wherein perforations (7) in the spinner cone (6) and the corresponding radial protrusions (10) of the insert body (9) are longitudinally shaped in the axial direction of the propeller shaft (4).

5. The propeller spinner (5) as recited in claim 4, wherein perforations (7) in the spinner cone (6) and the corresponding radial protrusions (10) of the insert body (9) are substantially rectangular.

6. The propeller spinner (5) as recited in claim 3, wherein perforations (7) in the spinner cone (6) and the corresponding radial protrusions (10) of the insert body (9) are arranged in multiple axially interspersed rows (A, B) along the outer peripheral surface (8) of the spinner cone (6).

7. The propeller spinner (5) as recited in claim 6, wherein each row (A, B) includes between six to sixteen perforations (7) and corresponding radial protrusions (10).

8. The propeller spinner (5) as recited in claim 1, wherein said anodic insert body (9) is removably attached to the spinner cone (6).

9. The propeller spinner (5) as recited in claim 1, wherein said anodic insert body (9) is permanently affixed to the spinner cone (6) and thereby forms a single replaceable unit.

10. The propeller spinner (5) as recited in claim 1, wherein said spinner cone (6) is substantially made of plastic.

11. The propeller spinner (5) as recited in claim 9, wherein said spinner cone (6) is molded directly onto the anodic insert body (9).

12. A marine propeller (1) comprising multiple propeller blades (2) attached to a propeller hub (3) adapted for attachment to a propeller shaft (4), said propeller (1) being provided with a propeller spinner (5) mounted on the propeller shaft (4) and comprising a sacrificial anodic material for protecting the propeller shaft (4) and/or propeller hub (3) from corrosion, said propeller spinner (5) comprising:

a hollow spinner cone (6) made of a non-anodic material, said spinner cone (6) having at least one perforation (7) in an outer peripheral surface thereof, and an anodic insert body (9) made of said sacrificial anodic material, said insert body (9) being substantially contained within the hollow spinner cone (6), the insert body (9) having at least one radial protrusion (10) extending at least partially through said perforation (7) in the spinner cone (6).

* * * * *